US007044463B2

(12) United States Patent
Brotherston et al.

(10) Patent No.: US 7,044,463 B2
(45) Date of Patent: May 16, 2006

(54) DOCUMENT FEEDER AND METHOD

(75) Inventors: Colin Peter Brotherston, Hampshire (GB); Steven Michael Hosking, Hampshire (GB); Bryan James Christophersen, Hampshire (GB)

(73) Assignee: De La Rue International Limited, Basingstoke (GB)

( * ) Notice: Subject to any disclaimer, the term of this patent is extended or adjusted under 35 U.S.C. 154(b) by 78 days.

(21) Appl. No.: 10/381,490

(22) PCT Filed: Sep. 25, 2001

(86) PCT No.: PCT/GB01/04268
§ 371 (c)(1),
(2), (4) Date: May 15, 2003

(87) PCT Pub. No.: WO02/26607

PCT Pub. Date: Apr. 4, 2002

(65) Prior Publication Data

US 2004/0099580 A1 May 27, 2004

(30) Foreign Application Priority Data

Sep. 26, 2000 (GB) ..... 0023587.9
Dec. 8, 2000 (GB) ..... 0030019.4

(51) Int. Cl.
*B65H 7/14* (2006.01)

(52) U.S. Cl. ..... 270/52.02; 209/583; 209/534; 235/462.01; 235/462.11

(58) Field of Classification Search ..... 270/52.02, 270/58.33, 58.31; 271/265.01, 265.02, 265.03, 271/3.13, 3.15, 4.02; 209/583, 534; 235/462.01, 235/462.11
See application file for complete search history.

(56) References Cited

U.S. PATENT DOCUMENTS

| | | | | |
|---|---|---|---|---|
| 4,248,528 | A | 2/1981 | Sahay | |
| 4,629,311 | A | 12/1986 | Kaneko et al. | |
| 5,039,077 | A * | 8/1991 | Gunther, Jr. | 270/52.02 |
| 5,067,088 | A * | 11/1991 | Schneiderhan | 700/221 |
| 5,364,085 | A * | 11/1994 | Kennish | 270/58.02 |
| 5,575,463 | A * | 11/1996 | Parkander | 270/52.02 |
| 5,729,001 | A | 3/1998 | Spitz | |
| 5,917,930 | A * | 6/1999 | Kayani et al. | 382/135 |
| 5,918,879 | A | 7/1999 | Steinhilber | |
| 6,032,947 | A * | 3/2000 | Parker | 271/213 |
| 6,224,048 | B1 * | 5/2001 | Motamed | 270/52.02 |
| 2001/0020688 | A1 | 9/2001 | Kawamura et al. | |

FOREIGN PATENT DOCUMENTS

| | | | |
|---|---|---|---|
| EP | 672604 B1 | * | 12/1998 |
| SE | 501944 B | * | 6/1995 |

* cited by examiner

*Primary Examiner*—Patrick Mackey
(74) *Attorney, Agent, or Firm*—Oliff & Berridge, PLC

(57) ABSTRACT

A document feeder comprises an input hopper (1) into which batches of documents with interleaved separators (24, 25) are loaded in use, each separator carrying data related to the associated batch. A feed system (9, 10) withdraws documents and separators singly from the input hopper. A sensing system (7) obtains information about the documents and separators. The sensing system includes a data sensor (7) located so as to read separator data while the separator (24, 25) is in the input hopper (1).

27 Claims, 9 Drawing Sheets

DOCUMENT FEEDER AND METHOD

The invention relates to a document feeder and a method of supplying documents, for example documents of value such as bank notes.

It is a common requirement to process documents, particularly documents of value such as bank notes, in batches. These are placed in an input hopper of a sorting or counting machine and are often fed through the machine continuously without the machine stopping.

In this case it is usual to use a separator document to mark the beginning and end of a batch. The separator at the beginning of a batch is called the header. The separator at the end of the batch is called the trailer. The separators are fed through the machine like normal notes except that when detected and after reading/detecting information contained thereon, they are generally routed to a destination to which reject/suspect notes are routed. This enables rejected or suspicious notes from the identified batch to be contained between headers and trailers or the identifying header and the following header for subsequent examination/inspection. In single pocket sheet counting machines the headers or trailers are sent to the single pocket to provide separating means between the batches processed when the sheets are removed from the pocket by the operator. It is, therefore, essential to recognise when the separator document has been fed into the machine to ensure that the rejected notes from each batch are identified with the batch that they came from. Monitoring separators is also important to indicate the batches which have been processed for recording purposes and to enable information to be provided about the contents of the batch.

It is further necessary to identify the batches using numbers on the headers. This can be done using a barcode printed on the separator. The barcode needs to be read by the sorter. The reading must be certain and accurate.

Traditionally, as shown for example in U.S. Pat. No. 4,248,528 and U.S. Pat. No. 4,629,311, the batch separator barcode reader has been positioned in the transport of the feeder at some distance from the input hopper. The reader takes the form of a static laser that scans the barcode as the separator moves through the beam.

As a batch separator may be fed accidentally with another document that would prevent the recognition of the separator, a further feature is often added to the separator. This feature takes the form of an ear that stands proud of the separator/note. A further optical sensor is able to recognise a pattern on the ear.

The ear sensor is mounted in the transport of the feeder but positioned as near as possible to the input hopper such that a separator may be recognised sufficiently quickly so as to enable the machine to stop feeding before the next document is fed. This is required in some modes of machine operation where the machine is required to stop at the end of each batch of notes.

This known approach has a number of disadvantages. For example, two sensors are needed to sense the ear and the barcode respectively. Furthermore existing arrangements require space between the sheet feeding means and the separator destination pocket for the separator detectors.

In accordance with a first aspect of the present invention, a method of supplying documents from a stack of documents at a storage location with a separator located between successive document batches, each separator carrying data related to the associated batch comprises supplying the documents and separators singly from the storage location; and obtaining information about the documents and separators; characterised by reading each separator data while the separator is still in the storage location.

In accordance with a second aspect of the present invention, a document feeder comprises a storage location into which batches of documents with interleaved separators are loaded in use, each separator carrying data related to the associated batch; a feed system for withdrawing documents and separators singly from the storage location; and a sensing system for obtaining information about the documents and separators, characterised in that the sensing system includes a data sensor located so as to read separator data while the separator is in the storage location.

This invention solves the problems mentioned above by reading the separator data while the separator is still in the storage location, such as an input hopper. The separator will either be stationary or moving relatively slowly as compared with its passage through the rest of the transport, so that the data can be read much more accurately than in the conventional approach described in the two US patent specifications mentioned above. Furthermore, it is not necessary to provide special separators with ears.

The documents may be fed from the bottom of the storage location, the separator data being read from underneath the storage location, or from the vertical or angled end of a storage location, when the separator data is read through the adjacent support plate. Comparable arrangements could be provided where sheets are fed from the top of a stack of sheets to be processed. This provides a convenient way of reading the separated data.

In the preferred example, the separator data is read more than once. This overcomes problems of mis-reads and the problem of handling a separator when it is already in the transport. Thus, the separator data or identity is known before the separator is fed into the machine.

Preferably, the separator data is read at more than one lateral position. This is helpful to overcome problems of damaged or badly printed data, particularly in the form of barcodes.

In some examples the separator data is read while the separator is being fed out of the storage location. This removes the need to scan the data. Typically, in this case a two part barcode would be used, one part of the code containing the barcode pattern defining the separator data, and the other containing a timing pattern. This allows the barcode to be correctly read despite variations in speed. The advantage of this approach over reading a stationary document is that a cheaper read head can be provided when scanning is not required, and the read head is more compact. Nevertheless, the use of the stationary document is preferred for the reasons mentioned above.

Although the invention has been described with reference to separators, it is applicable more widely.

Thus, in accordance with a third aspect of the present invention, document supply apparatus comprises a feed system for feeding documents from a storage location; and a detector for detecting one or more characteristics of a document, the feed system feeding the document in accordance with the detected characteristic, characterised in that the detector includes a sensor located so as to sense the document characteristic(s) while the document is in the storage location.

In accordance with a fourth aspect of the present invention, a method of supplying documents from a stack of documents at a storage location comprises detecting one or more characteristics of the document to be fed while the document is in the storage location; and supplying the document in a manner determined in accordance with the detected characteristic(s).

By detecting document characteristics while the document is still at the storage location, the difficulties of detecting characteristics while the document is moving, often at very high speed, are overcome. In addition, problems of operating detectors due to skew and irregular scanning of the note because of speed variations in the transport are also reduced.

This invention is applicable to a wide variety of different document feeding applications, including bank note sorters, counters and acceptors. It is also applicable to the feeding of documents with either their long edge or short edge leading while, when the separator data is read by scanning a reading beam across the data, this may be in any direction relative to the feed direction.

Some examples of methods of sorting documents and document sorters according to the invention will now be described with reference to the accompanying drawings, in which.

Figure 1:
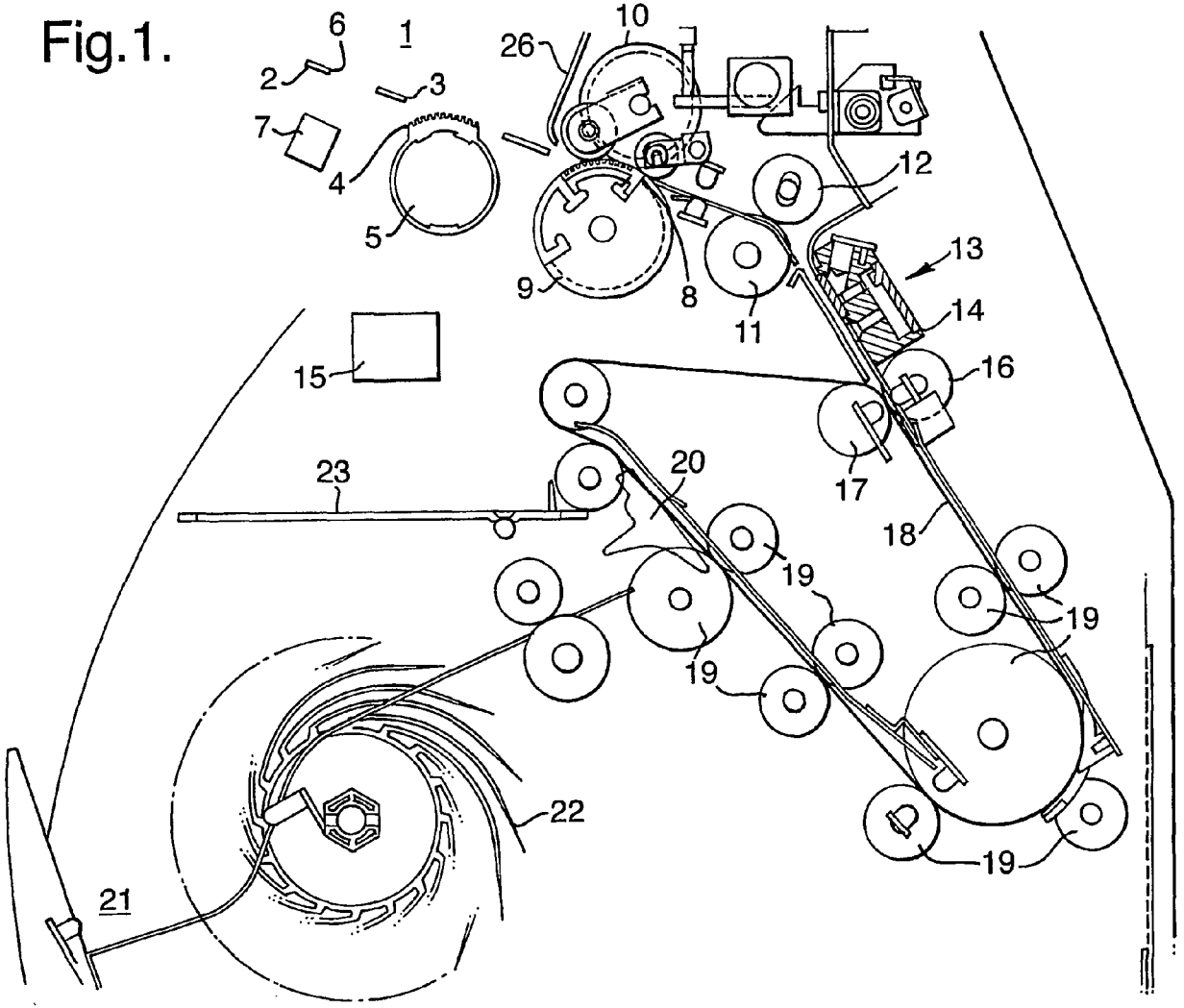
FIG. 1 is a side view of the main feed and transport components of a first example of a document sorter.

The document sorter shown in FIG. 1 comprises an input hopper 1 having a base 2 with an aperture 3, through which a high friction portion 4 of a nudger wheel 5 can project. The base 2 has a second aperture 6 in alignment with a barcode reader 7 as will be described in more detail below. Bank notes are supported in a stack on the base 2 against a front wall 26, and are fed intermittently by rotation of the nudger roller 5 into a nip 8, between a high friction feed roller 9 and a separator, counter rotating roller 10. The documents pass through pinch rollers 11, 12 into a pattern detection region 13 in which a sensor 14 scans the bank note as it is fed and passes information back to a microprocessor 15, which controls overall operation of the machine. Each bank note is then fed through pinch rollers 16, 17 onto a drive belt 18 which conveys the bank note around various rollers 19 to a diverter 20. The position of the diverter 20 is controlled by the microprocessor 15, so that bank notes are guided either towards an output pocket 21, where they are stacked using a rotating stacking wheel 22 in a conventional manner, or to a reject bin 23.

Figure 2:
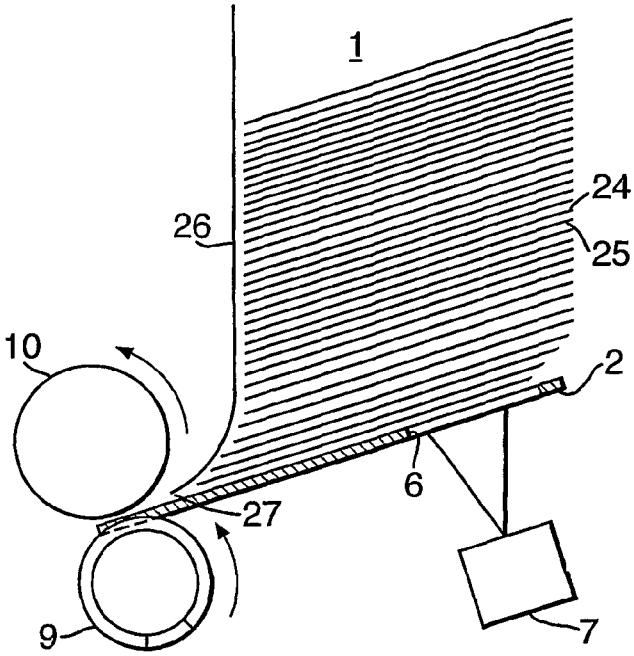
FIG. 2 illustrates the input hopper of FIG. 1 in more detail.

In this case, bank notes from separate sources are stacked in the input hopper 1, one above the other, with a header separator 24 (FIG. 2) below each batch and a trailer separator 25 above each batch. There will thus be a trailer and header next to each other between each batch as shown in FIG. 2. The nudger roller 5 has been omitted for clarity in FIG. 2.

As can be seen in FIG. 2, the bank notes are stacked on the base 2 and are urged forward against the front wall 26. A small gap 27 is provided at the base of the front wall, through which individual bank notes and separators can be nudged.

The lowermost sheet in the input hopper 1 is scanned by the scanning barcode reader 7, which moves the laser beam across part of the document visible through the aperture 6 while the document is stationary in the input hopper. When either a trailer separator 25 or a header separator 24 is the lowermost document, then the aperture 6 allows a barcode to be visible to the reader 7. Typically, the laser beam is scanned more than once across the barcode to enable it to be read accurately, and this information is supplied to the microprocessor 15.

Figure 3:
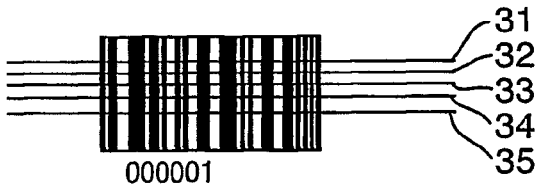
FIGS. 3 and 4 illustrate two examples of barcodes.

An example of a barcode is shown in FIG. 3, and in this case it will be seen that the scanning laser beam is scanned across the bar code in five lateral scans 31–35. The advantage of this is that if the barcode was partly damaged, then at least one of the scans is likely to traverse a non-damaged portion.

Typically, the barcode will be printed on both sides of the separators, so that it does not matter which way round the separator is placed into the output hopper. The scan will also be carried out rapidly, since typically documents are fed at about 800 documents or more a minute.

As soon as the barcode reader 7 has recognised the barcode, it will send the barcode identity to the microprocessor or machine controller 15, and depending upon the type of process selected, the machine controller may stop the feeder before the separator is fed to allow the previous batch to be removed from the output pocket 21, or it may allow the separator to be fed and process the next batch immediately.

Although it might be possible that a trailer separator could be fed with the note preceding it, thus causing the trailer barcode to be missed by the reader, the presence of an additional header separator as the next document will alert the machine to the missed trailer.

A bar-code may also be scanned using a static (non moving) illumination means and CCD array to read the code. This type of reader is typical of readers used in retail outlets to scan the code on articles passed over the scanner.

Figure 4:
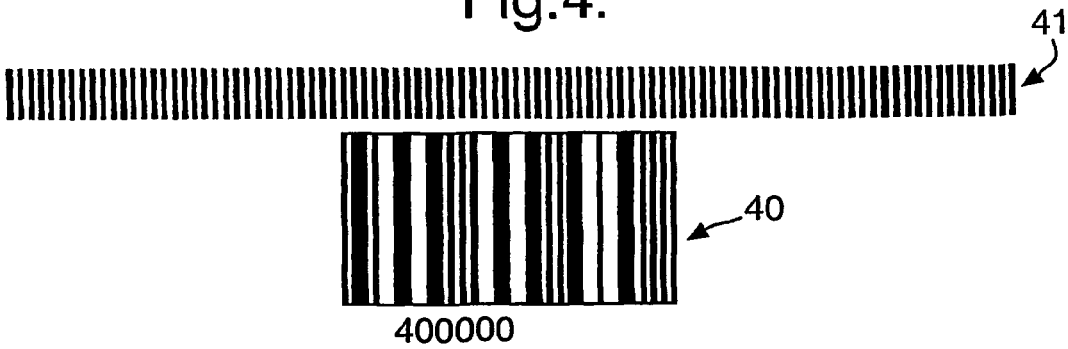

In a modified approach, the scanning barcode reader is replaced by a non-scanning version, and a scan is achieved by utilising feed movement of the separator document itself. In this case, it is necessary to provide both a barcode 40 (FIG. 4) and a timing pattern 41 on the separated document, so that the barcode can be correctly read despite variations in the speed of the document.

Once the lowermost document has been nudged through the gap 27, it is picked up by the feed roller 9 and fed onto the sensing section 13. The sensing section 13 determines one or more of the identity or authenticity of the document. The document is then fed to the diverter 20, which is controlled by the microcontroller 15 to feed it to the stacking pocket 21, or the reject bin 23 according to information from the sensing section 13. Typically, authenticated or identified documents are fed to the output pocket 21, while rejected documents and separators are fed to the reject bin 23.

Figure 5:
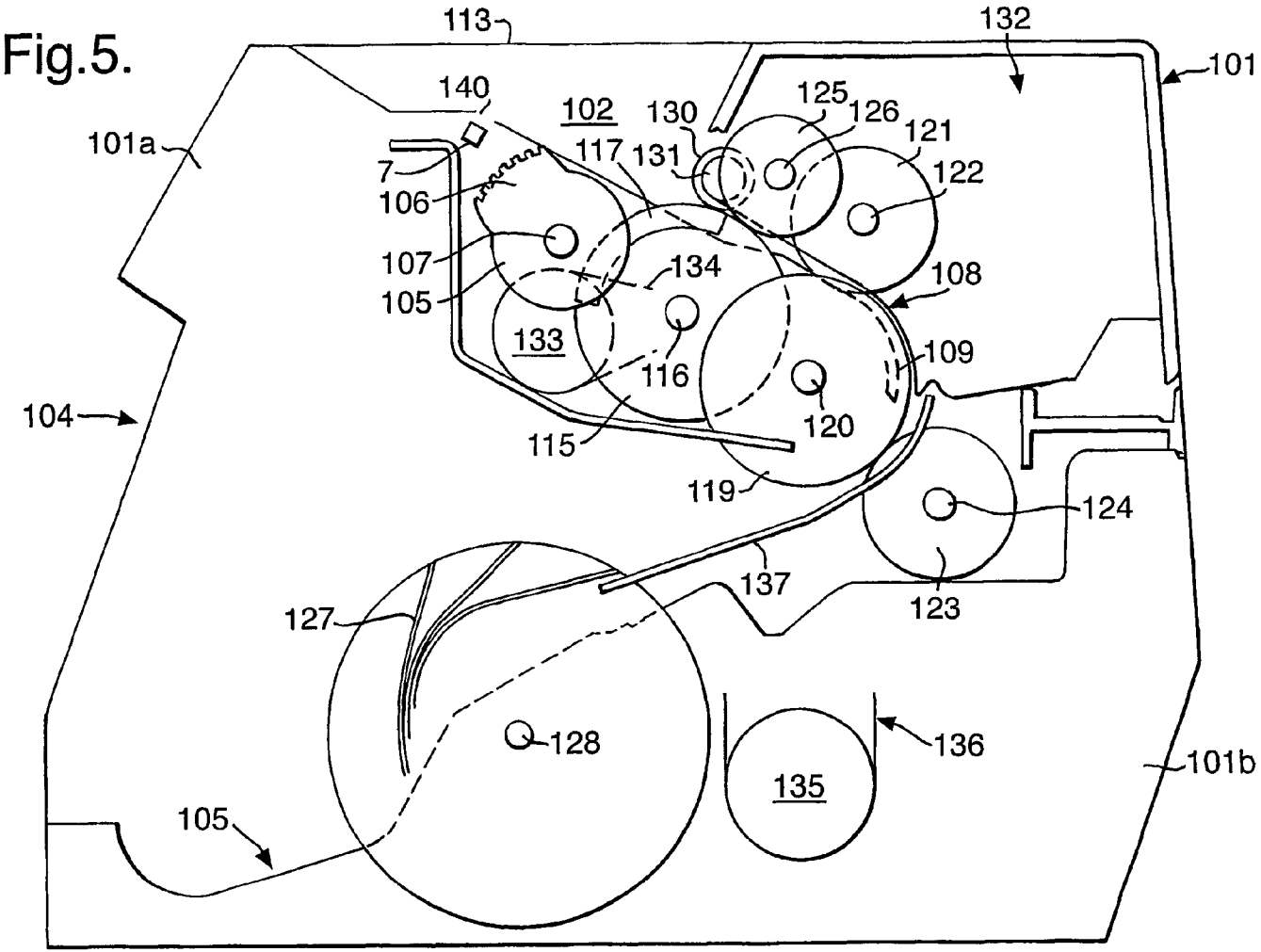
FIG. 5 is a view similar to FIG. 1 but of a second example.

FIG. 5 illustrates a second example of a counter, with a single output receptacle. The counter 104 includes a document feed hopper 102 mounted beneath the inlet opening 103 in an enclosure 101 which comprises upper and lower parts 101*a*, 101*b* normally screwed together. Contained within the enclosure 101 is an internal chassis assembly (not shown for clarity) which itself has side members between which the sheet feeding and transport components to be described herein, are mounted. Two conventional feed wheels 105 are non-rotatably mounted on a shaft 107, which is rotatably mounted to the chassis assembly, and have radially outwardly projecting bosses 106 which, as the feed wheels rotate, periodically protrude through slots in the base of the hopper 102.

A pair of stripper wheels 115 are non-rotatably mounted on a drive shaft 116 which is rotatably mounted in the chassis assembly. Each stripper wheel 115 has an insert 117 of rubber in its peripheral surface. Shaft 116 is driven clockwise via a belt 134 by a motor 133 to feed notes individually from the bottom of a stack of notes (not shown) placed in the hopper 102.

Transversely in alignment with, and driven from the circumferential peripheral surface of the stripper wheels 115, are pressure rollers 130 which are rotatably mounted on shafts 131 spring biased towards the stripper wheels 115. Downstream of the wheels 115 is a pair of transport rollers 119 non-rotatably mounted on a shaft 120 rotatably mounted in the chassis assembly. Shaft 120 is driven clockwise as shown in FIG. 5 via a belt 136 from a second motor 135 to transport the note in the transport arrangement, in conjunction with pairs of pinch rollers 121 and double detector rollers 123, into the stacking feed 127 mounted on shaft 128. Pinch rollers 121, rotatably mounted on shafts 122 spring biased towards the transport rollers 119, transversely align with rollers 119 and are driven by the peripheral surface of the rollers 119 whilst the double detector rollers 123, rotatably mounted on shafts 124 non rotatably mounted to the chassis assembly, although also in in alignment with the transport rollers 119, are essentially caused to rotate by the note passing between the adjacent peripheral surfaces of the rollers 119 and 123.

The shafts 131 and 122 are mounted in a top moulding assembly 132 which is hinged from and forms part of the chassis assembly.

Situated between the pressure rollers 130 and pinch rollers 121 are separator roller pair 125, non-rotatably mounted on shaft 126 adjustably fixed to the top moulding assembly 132, having a circumferential peripheral surface which is nominally in alignment with the peripheral circumferential surface of, but transversely separated from, the stripper wheels 115.

Also forming part of the top moulding assembly 132, is a curved guide surface 108 extending partly around the circumference of the rollers 115,119 which, when the top moulding is lifted allows the operator access to the note feed and transport path so that a note jam can be cleared. A surface 137 provides note guiding from the end of the curved guide surface 108 to the conventional stacker wheels 127.

The drive motor 133 (shown schematically in FIG. 5) continuously drives the drive shaft 116 via the drive belt 24 and, via a belt and pulley arrangement from shaft 116, the auxiliary drive shaft 107 rotating the feed wheel 105. The connection between the drive motor belt 133 and the drive shafts 107,116 has been omitted for clarity. Drive shaft 120, rotating the transport rollers 119, is driven via a belt drive 136 by a drive motor 135. A further pulley and belt arrangement (not shown) between shaft 120 and shaft 128, on which the stacker wheels 127 are non rotatably mounted, provides the drive to the stacker wheels 127 from drive motor 135.

A guide plate 109 extends as a continuation of the base of the hopper 102 towards the nips formed between the transport rollers 119 and the double detector rollers 122.

The control system for the example shown in FIG. 5 will not be described since this should be self-explanatory.

As in the previous example, the base of the feed hopper 102 has an aperture 140 behind which is situated a bar code reader 7. This operates in exactly the same way as the bar code reader in the first example being connected to a microprocessor (not shown) and so will not be described any further.

Figure 6:
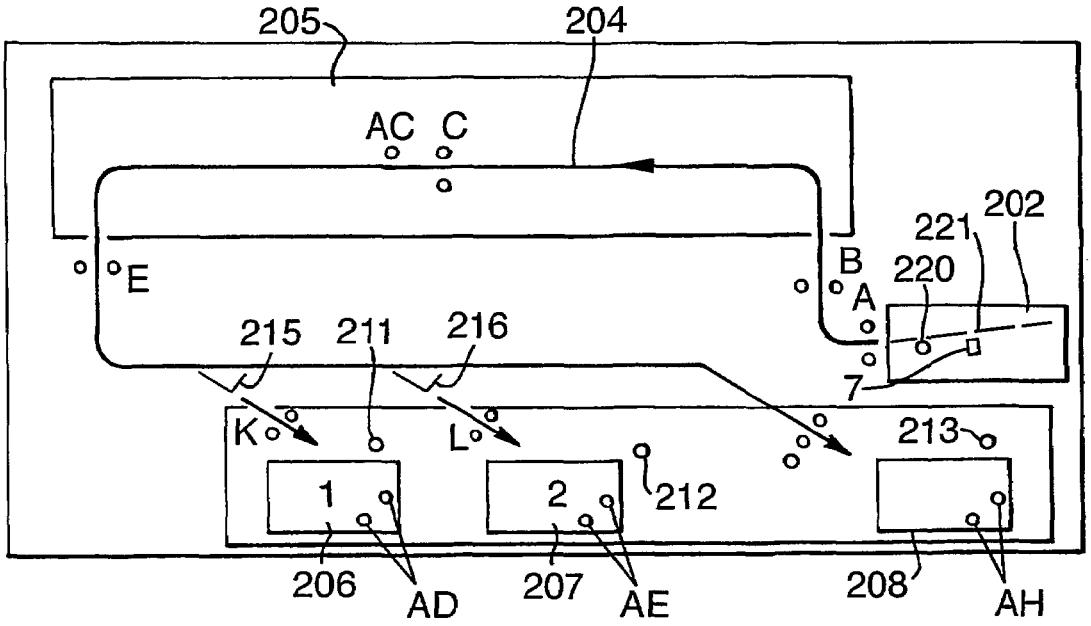
FIG. 6 is a view similar to FIG. 1 but of a third example.

The third example shown in FIG. 6 comprises a sheet input station or hopper 202 to hold a bundle of sheets positioned in the input station by the machine operator. The hopper 202 includes a base 220 on which the sheets rest in use. The base 220 has an aperture 221 aligned with a bar code reader 7 as in the previous examples. Again, the bar code reader 7 will be connected to a microprocessor (not shown) and will operate in a similar manner to the previous examples. The lowermost sheet in a stack on the base 220 is fed forward upon rotation of a friction feed roller 222. In this case, sheets are fed with their short edge leading in contrast to the previous two examples in which the sheets were fed long edge leading. The sheets are fed one at a time from the bundle of sheets by the roller 20 into a sheet transport system 204 to transport the individual sheets through a detector area 205 to one of a number of stacking pockets or output stations 206,207,208. Sheets are directed to the pockets 206,207 by diverting arrangements 215,216 respectively which are operated by a machine processor or controller (not shown) in accordance with its programmed process control instructions which utilise at least one detected characteristic of each sheet to determine the destination of that sheet. Sheets not diverted by diverting arrangements 215,216 are fed to the pocket 208. Typically the pocket 208 is used as a cull pocket. The input station 202 is designed to enable additional bundles of sheets for processing to be added to the station as the sheets are moved into the transport system 204.

Associated with each of the stacking pockets 206,207,208 are respective indicators 211,212,213 which in these examples are audible or visual indicators but can be any known means available to alert the operator to remove the stack of sheets from the associated pocket, which also operate on instructions provided by the machine processor in accordance with the programmed process control instructions.

Other indicating means include the use of stacking pockets which automatically move out from the machine when the stacker has been determined full in order that the operator can remove the stacked contents, and the automatic ejection, transporting or dropping of a stack of sheets after the stack has been automatically banded.

So far the examples have been concerned with handling separators. As explained earlier, however, the invention is also concerned with document handling more generally as the following examples will show.

Figure 7:
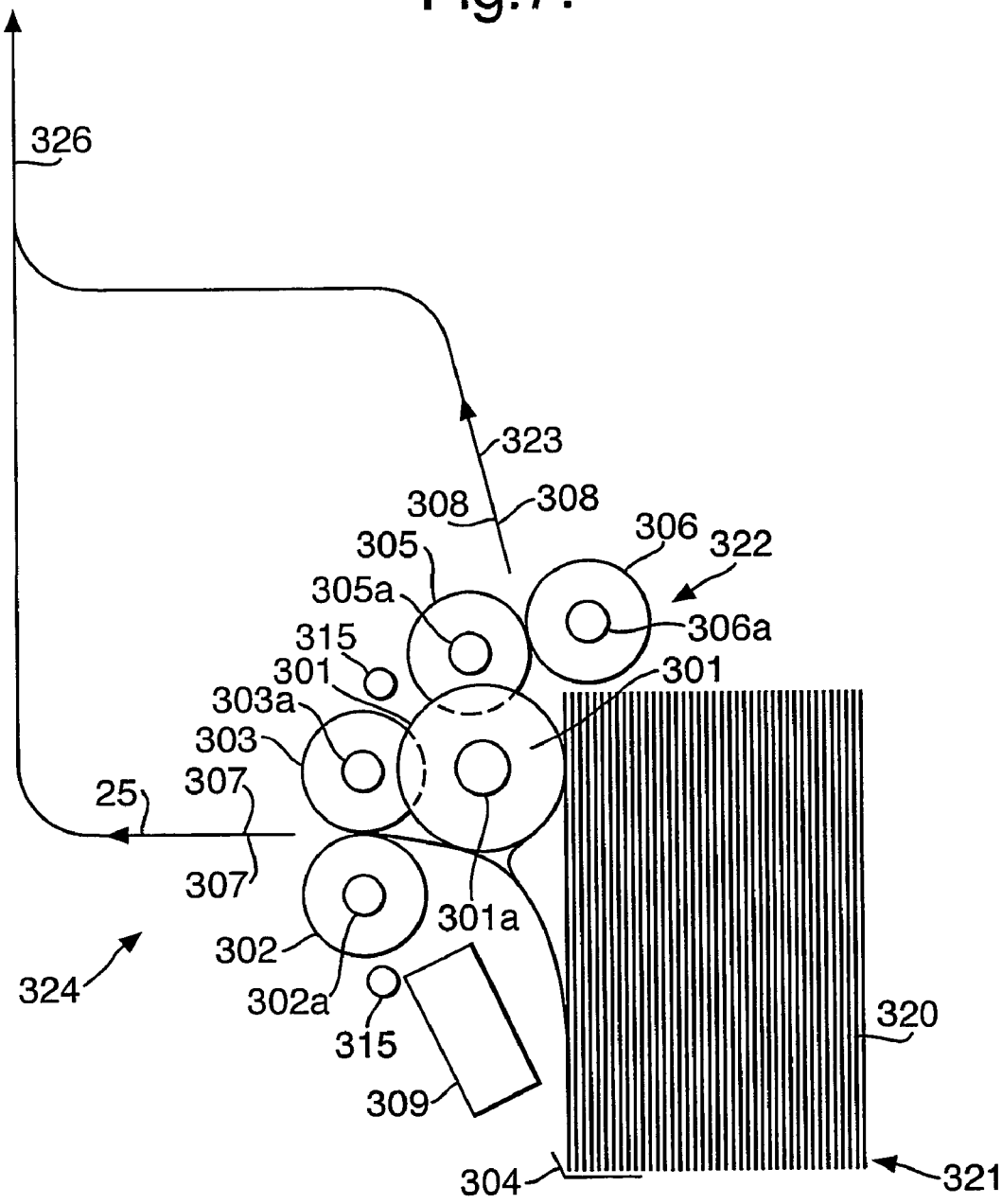
FIG. 7 is a schematic diagram of a fourth example.

As shown in FIG. 7 a document pack such as a banknote cassette 320 is supported at a storage location 321. Sets of rollers 301,302,303,305,306 are mounted non-rotatably on respective shafts which extend between side plates (not shown in FIG. 1) of the apparatus. As shown in FIG. 7, a number of high friction pick rollers 301 (although only a single such roller is shown) are mounted adjacent the storage location 321 so that the rollers 301 engage the leading banknote in the cassette. The banknotes will be urged against the rollers by biassing means (not shown).

A first pick system 322 is formed by the rollers 301 and one or more pairs of cooperating separation rollers 305,306 defining a separation nip between them (only one pair visible in FIG. 1). The separation forward drive rollers 305 are mounted on a shaft 305*a* which is supported within bearings mounted in each side plate, and which, where it extends outside of the side plate, is driven via a one way clutch and toothed arrangement, anticlockwise from a toothed pulley fixed to shaft 301*a* driven anticlockwise by the pick roller motor drive system. The one way clutch enables shaft 305*a* to be rotated anticlockwise by documents being pulled down from between the rollers 305,306 by a downstream transport system (not shown) when the drive from shaft 301*a* is inactive or is rotating clockwise. The whole circumference of rollers 305 has a high friction surface. Separation pinch rollers 306 are mounted on a shaft 306*a* which is rotatably mounted within bearings mounted in the side plates. These rollers are friction driven clockwise by pinch against the separation forward drive rollers 305, however an anticlockwise torque is also applied by an additional motor (not shown) driving shaft 306*a*. This motor torque is overcome by the anticlockwise pinch torque applied by the action of the separation forward drive rollers 305 whilst no documents (or single documents) are present. When a multiple document, comprising two or more, attempts to be fed through the separation pinch the anticlockwise motor drive torque on shaft 306*a* is greater than the friction drive between the documents. The multiple is therefore separated allowing only the document in contact with the separation forward drive rollers 305 to progress through the pinch of output 302.

When active, the rollers 305 rotate in an anticlockwise direction to feed sheets in the direction of arrow 323 while the rollers 306 are driven clockwise by the pinch of the roller 305 when no or single documents are introduced into the pinch but reverses when multiple documents are introduced.

A second pick system 324 is formed by the rollers 301 and one or more pairs of separation rollers 302,303.

Separation forward drive rollers 302 mounted on shaft 302*a* suitably rotatably supported within bearings in the side plates, are driven anticlockwise via a one way clutch by an independent motor (not shown) and are able to be rotated anticlockwise by documents being pulled from between the rollers 302,303 by a downstream transport system (not shown) without the independent drive motor being activated. The whole circumference of the rollers 302 has a high friction surface.

Separation pinch rollers 303 are non-rotatably mounted on a shaft 303*a* supported within bearings mounted in the side plates (not shown). The rollers are friction driven clockwise by pinch against the separation forward drive rollers 302, however an anticlockwise torque is also applied by an additional motor (not shown) driving shaft 303*a*. This motor torque is overcome by the anticlockwise pinch torque applied by the action of the separation forward drive rollers 302 whilst no documents (or single documents) are present. When a multiple document, comprising two or more, attempts to be fed through the separation pinch the anticlockwise motor drive torque on shaft 303*a* is greater than the friction drive between the documents. The multiple is therefore separated allowing only the document in contact with the separation forward drive rollers 302 to progress through to the document output 301.

Separation elements 304 are built into the floor of the apparatus upon which the documents stand in use and are used to separate the documents when being fed by their own host pick feeder. The separation elements 304 retain and provide support for the documents interfaced to the universal feeder. They may be integral to the universal feeder although usually they are part of the applied document receptacle (such as a document cassette).

Each pick system 322,324 has a respective sensor 308,307 for generating and detecting a light beam which is interrupted by the passage of a document. The sensors are connected to a control system (not shown) which controls the motor (also not shown) for rotating the pick systems so that the pick systems are deactivated either once a sheet is has been fed or once the process control system indicates no further sheets are to be fed. Furthermore, sensors 307,308 also sense if more than one note has been transported through the separating rollers 305,306 or 302,303 in which case a process control system flag is set to either cause the feed systems to stop feeding or the downstream transport arrangement to divert the multiple notes as culls or to determine the number of multiple notes sensed or to undertake any combination of these actions.

In order to detect characteristics of the sheets, a detection system 309 is provided having a sensor adjacent the leading most sheet in the stack 320 to determine one or more characteristics such as pattern (e.g. for denomination), authentication and fitness while the sheet is substantially stationary.

In use, depending upon the type of cassette located at the storage location 321, either the pick system 322 or the pick system 324, or selectively both pick systems will be activated by the control system activating the pick roller shaft drive motor to rotate in either the clockwise or anticlockwise direction. In each case, the process control system receives data either provided by an operator input, or provided by a system input or any known arrangement, for example bar code, electronic sensing, hardware connection, magnetic code, smart card etc., which enables the pack device type to be identified by or to the process control system. Following instructions within the process control system, the rollers 301 will be activated either in an anticlockwise direction when the pick system 322 is active or in a clockwise direction when the pick system 324 is active.

As shown in FIG. 7, after being picked from the stack 320, the documents are fed along respective paths (by means not shown) to an optional common transport path 326 for subsequent passage to their ultimate destination.

In another arrangement (not shown), the documents may be supplied to different destinations determined in accordance with which one of the pick systems 322,324 is active. In this case, the control system can respond to information from the detector system 309 to activate an appropriate one of the pick systems 322,324.

A typical mode of operation will now be described for the arrangement involving a universal cassette from which banknotes can be withdrawn by either or both pick systems:

1. The detection system 309, which is viewing the surface of the substantially static facing document of the pack 320, senses the characteristics of the note surface in the period before the process control system sends a feed command to instruct the motor driving the feed roller shaft 301*a* to rotate. Although the detection system can be configured to supply information regarding denomination, authentication, and fitness, for the purposes of this example it is providing authentication/fitness data.
2. The detector system declares the document authentic and fit. The process control system sets a flag to activate the feed system to direct the note in direction 323.
3. Pick rollers 301 in contact with the document pack 320 that is being urged against them by, for example, spring pressure (not shown) rotates anticlockwise. Hence, primary "pick" is achieved and the document is pulled up and its leading edge is directed towards the pinch of the separation system rollers 305,306. Primary separation (hence an inter-document gap) is obtained by accelerating the pick rollers 301 from zero to transport speed (or just below) and back to zero before a second document can be picked. The document transport is not shown but is indicated as output 302.

4. The document present sensor 308 determines when the fed document has cleared the feed system 322 and flags the process control system that the feed system is ready to feed the next document from the pack 320.
5. Alternatively at step 302, the detector system declares the document not fit and the process control system sets a flag to activate the feed system to direct the note in the direction 325.
6. In that case, the primary "pick" is achieved by clockwise rotation of the pick rollers 301 in order that the leading edge of the document is directed towards the pinch of the rollers 302,303.
7. The document present sensor 307 determines when the fed document has cleared the feed system 324 and flags the process control system that the feed system is ready to feed the next document from the pack 320.

In summary:

The detection system assesses a document before pick. (In the option described above, authenticity and fitness information are the parameters required by the universal feeder to determine to which output documents are directed.)

Documents suitable for further processing downstream are picked by anticlockwise rotation of the pick rollers 301 and sympathetic action of the associated processing separation system to deliver the document to output 302 (the interface to the processing transport of the host-system).

Documents unsuitable for further processing downstream are picked by clockwise rotation of the pick rollers 302 and sympathetic action of the associated return separation system to deliver the document to output 301 (the interface to the return transport of the host system). Of course, the above example describes the process involved in using the universal feed system and detector system with a universal cassette as a basic document sorter system for outsorting documents not fit for a particular purpose from those sensed as fit for the purpose. In this case, the two sets of documents are transported to different destinations.

Although the system described defines the output for processing to be output 302 and the output for return to be output 301, the system would be equally effective if the output functions were reversed.

The ability to "cull" unwanted documents at the input of the feeder makes this fully populated version of the universal feeder an ideal input medium for systems requiring self-service input to deposit/recirculating machines and to low speed sorting applications.

Figure 8A:
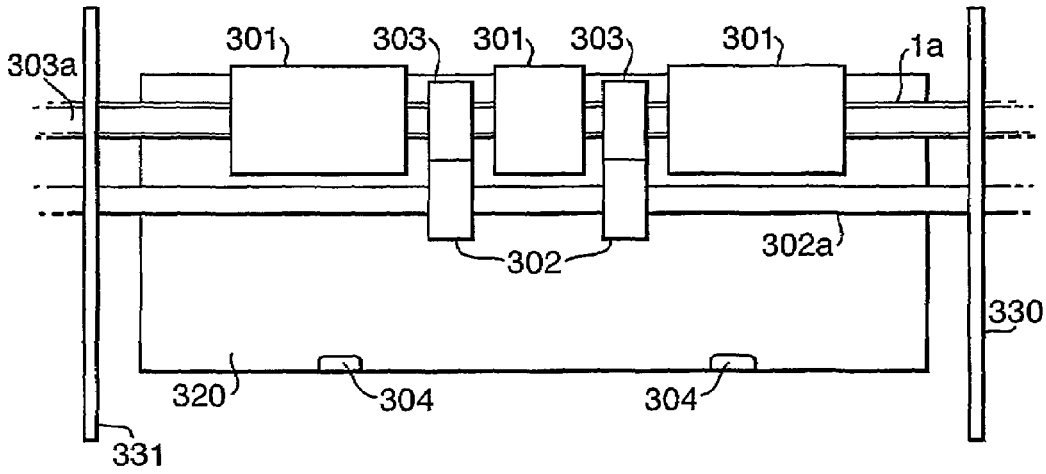
FIGS. 8A and 8B are a schematic plan and side view of the apparatus of FIG. 7 illustrating the components which are active when configured for withdrawing documents from a cassette designed for a vacuum feed system.
Figure 8B:
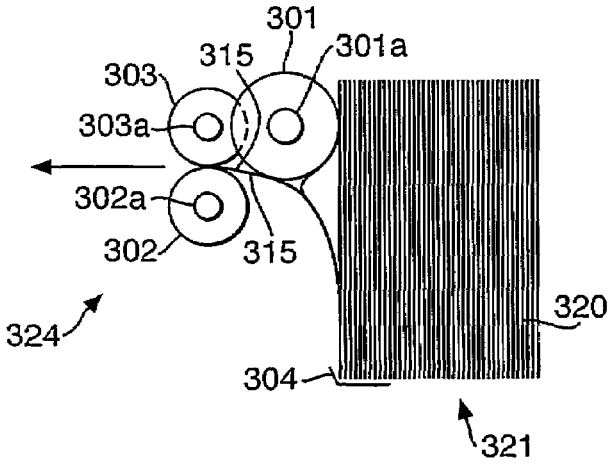

FIG. 8 illustrates the active components when the document handling system is used with a document cassette adapted for use with a reciprocating vacuum pick feed device. In this case, the pick system 324 only is used.

In this example, three pick rollers 301 are shown in FIG. 8A (together with two pairs of opposed separation rollers 302,303). As can be seen in FIG. 8A, the rollers 302 are mounted non-rotatably on a shaft 302*a* supported within bearings (not shown) in side plates 330,331. The rollers 303 are non-rotatably mounted on a shaft 303*a* supported within bearings (not shown) in the side plates 330,331. The rollers 301 are supported non-rotatably on a shaft 1*a* extending between the side plates 330,331 to which they are supported within bearings.

In addition, a sensor system 315 generates a light beam upstream of the rollers 302,303 so as to detect the presence of a document and cause the process control system to switch off the pick motor and to keep on the independent drive motor driving shaft 302*a*. Thus, when the separation rollers 302,303 have caused multiple fed documents to be held back whilst the single document, which should have been the only document fed, is detected by the sensors 307 to have left the rollers 302,303 pinch, the motor driving shaft 302*a* causes rollers 302 to transport the next document of the multiple feed through the separation roller system. In circumstances, for example, where detector 309 is being utilized to sense characteristics of the facing document, the independent motor can be switched off and then back on again to assist the detector process and/or to provide adequate document to document spacing between the documents leaving the separator roller system, such action continuing until sensors 315 detect a document is no longer present.

As already described above in connection with FIG. 7, the rollers 302 are gear driven from the pick motor (or may driven by an independent separator motor) capable of forward free wheel. The rollers 303 receive an anticlockwise torque applied by an additional DC motor (not shown) but are driven clockwise by rollers 302 until a multiple document appears at the pinch.

Figure 9A:
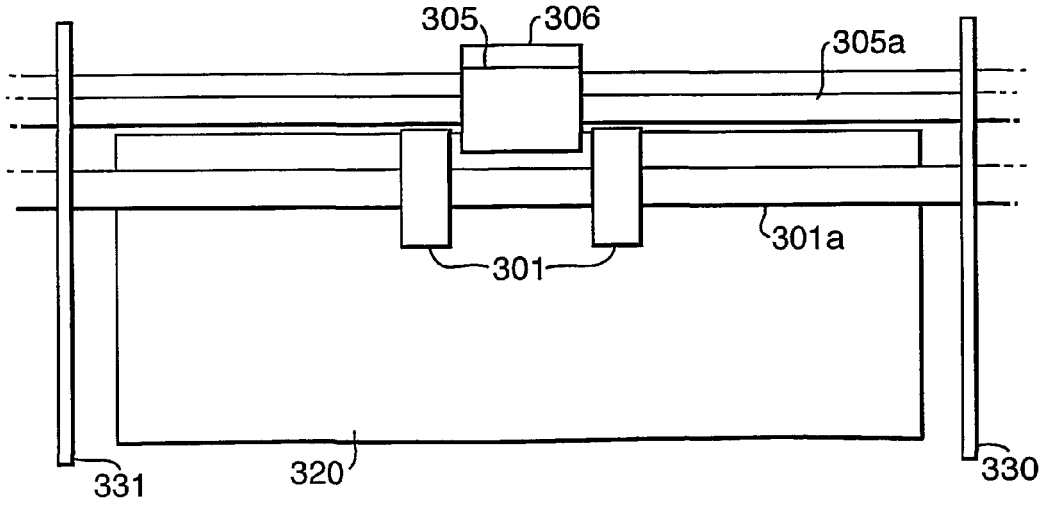
FIGS. 9A and 9B are views similar to FIGS. 8A and 8B respectively but configured for use with a cassette for a friction feed system.
Figure 9B:
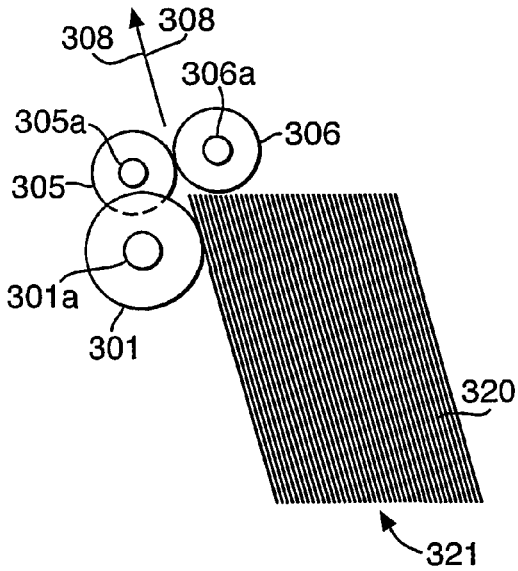

FIG. 9 illustrates the active components when the document handling system is used for feeding documents from a friction feed designed cassette. As shown in FIG. 9A, the roller 305 is non-rotatably mounted on a shaft 305*a* extending between side plates 330,331 in which it is supported by bearings. The roller 306 is non-rotatably mounted on a shaft 306*a* extending between bearings in the side plates 330,331.

As before, the sensors 308 detect the passage of a document and are used to control the pick motor (not shown) which drives the pick rollers 301.

Figure 10A:
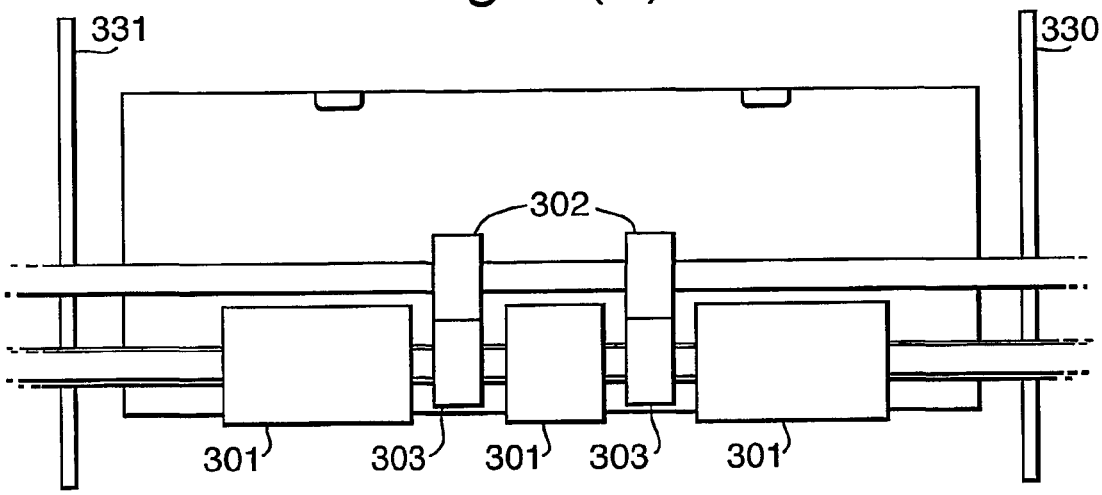
FIGS. 10A and 10B are views similar to FIGS. 8A and 8B but for an inverted configuration.
Figure 10B:
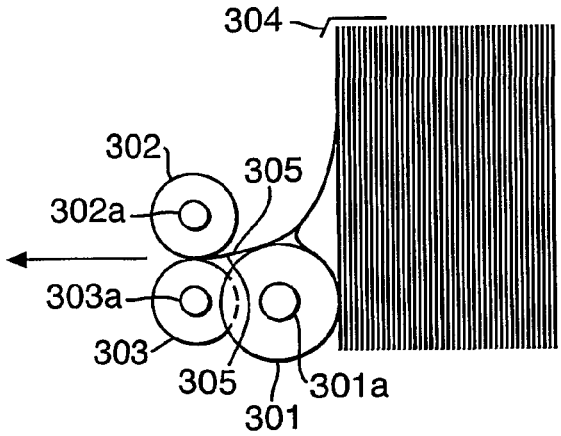

Finally, FIG. 10 illustrates an inverted version of the FIG. 8 example which is suitable for some configurations. The same reference numerals are used to designate the same elements and we believe that operation of this system is self-explanatory.

The location of the detector 309 will depend upon the type of document store being used. FIGS. 305*a* and 305*b* illustrate a vacuum feed document store in which a vacuum feed roller 350 is mounted to protrude through an end wall 352 of the store. Banknotes (not shown) are pressed up against the end wall 352 with their major faces in engagement with the vacuum roller 350. A pair of detectors 309A,309B are mounted one above the other in the end wall so as to view information on the facing surface of the leading most banknote and a vacuum pad 354 is also mounted to open through the end wall as shown in FIG. 11*b*. In use, the vacuum applied to the vacuum pad 354 is turned off at the time a banknote is to be fed out through an outlet slot 326 (as is known) and the detectors 309A,309B can obtain information from the leading most banknote either while it is stationary in the store or while it is being fed out. As before, this can be used to control the ultimate destination of the banknote.

Figure 11A:
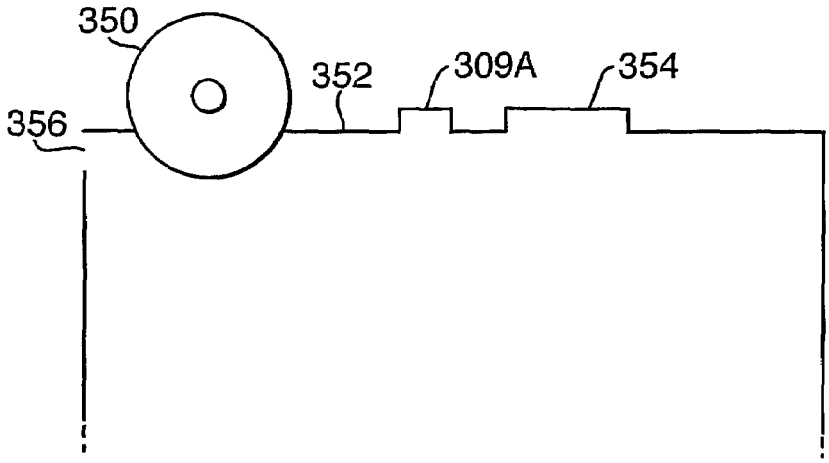
FIGS. 11A and 11B are schematic plan and end views respectively of an alternative document store; and, FIG. 12 is a schematic side view of part of a further document store.
Figure 11B:
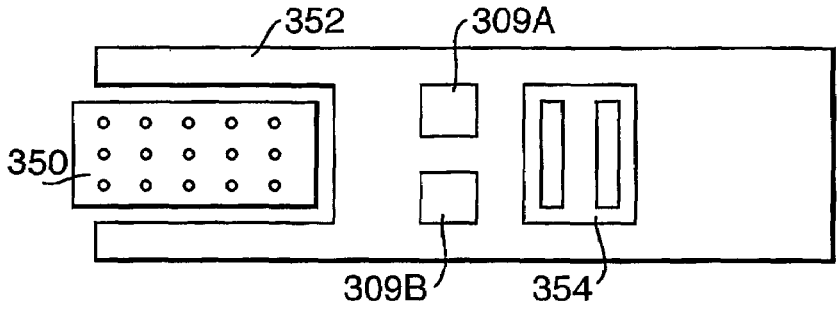
Figure 12:
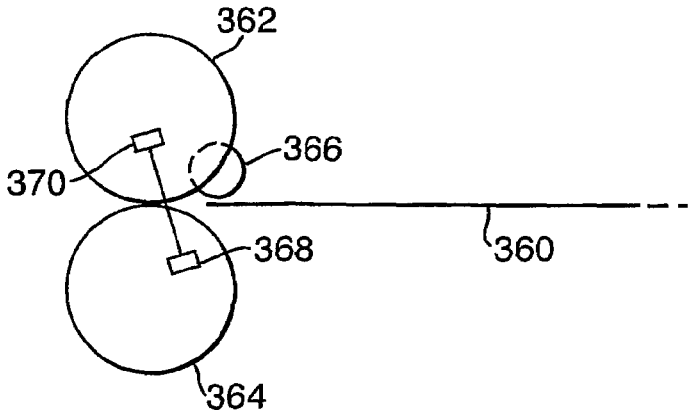

In the FIG. 11 example, the detectors 309A,309B are reflective. FIG. 12 illustrates a transmissive arrangement. In this case, banknotes (not shown) in the store are supported on a feed plate 360 and are nudged forward in a conventional manner by a nudging roller (not shown). The lowermost document is fed into a nip between the pair of feed rollers 362,364 while a stationary or slowly counter rotating separation roller 366 prevents more than one sheet or document being fed. The radiation source 368 generates a radiation beam which is detected by a detector 370 as the leading most document is fed through the nip between the rollers 362,364 and this allows characteristics of the fed document such as the presence of a double, its condition, authentication, pattern and the like to be detected.

In other cases, two reflective detector/source arrangements could be provided on opposite sides of the feed path instead of the source 368/detector 370 arrangement. It is also possible to use a single reflective arrangement.

The invention claimed is:

1. A method of supplying documents from a stack of documents at a storage location, comprising:

stacking a plurality of documents and separators at the storage location with a separator located between successive document batches, each separator carrying data related to the associated batch;

supplying the documents and separators singly from the storage location; and obtaining information about the documents and separators, including detecting and reading separator data for each separator while the separator is in the storage location.

2. A method according to claim 1, wherein the separator is stationary when the data is read.

3. A method according to claim 1, wherein the documents are supplied from the bottom of the storage location, the separator data being read from underneath the storage location.

4. A method according to claim 1, wherein the separator data is read more than once.

5. A method according to claim 4, wherein the separator data is read at more than one lateral position.

6. A method according to claim 1, wherein the separator data comprises a bar code.

7. A method according to claim 1, wherein the separator data defines a batch number.

8. A method according to claim 1, wherein the information obtained about the documents comprises one or more of authenticity, identification, and size information.

9. A method according to claim 1, further comprising supplying the documents and separators to one of a number of output locations depending on the information obtained about each document and separator.

10. A method according to claim 1, further comprising supplying the documents and separators to the same output location.

11. A method according to claim 1, wherein the documents comprise banknotes or similar documents of value.

12. A method of feeding documents from a stack of documents at a storage location, the method comprising:

detecting one or more characteristics of the document to be fed while the document is in the storage location, the detected characteristic(s) relating to one or more of the authenticity, condition, fitness and denomination or other predetermined pattern of the document; and supplying the document to a feed system capable of receiving documents only from said stack and in a manner determined in accordance with the detected characteristic(s), the feed system selectively supplying a document to an output stack in accordance with the detected characteristic(s), or each output stack being capable of receiving documents only via the feed system.

13. A method according to claim 12, wherein the document is stationary in the storage location when the characteristic(s) is sensed.

14. A method according to claim 12, wherein the supplying step comprises supplying the document to one of a number of destinations in accordance with the detected characteristic(s).

15. A method according to claim 12, wherein the documents are fed to one of a plurality of output locations selected in accordance with the detected characteristic(s).

16. A method according to claim 12, wherein the documents comprise banknotes or similar documents of value.

17. A document feeder comprising:

a storage location into which batches of documents with interleaved separators are loaded in use, each separator carrying data related to the associated batch;

a feed system for withdrawing documents and separators singly from the storage location; and a sensing system for obtaining information about the documents and separators, the sensing system including a data sensor located so as to detect and read separator data for each separator while the separator is in the storage location.

18. A feeder according to claim 17, wherein the feed system withdraws documents and separators from the bottom of the storage location, the data sensor being positioned to read separator data when each separator is at the bottom of the storage location.

19. A feeder according to claim 17, wherein the data sensor comprises a scanning beam and a reflectance detector.

20. A feeder according to claim 19, wherein the data sensor scans separator data at more than one lateral position.

21. A feeder according to claim 17, wherein the data sensor comprises an illumination means and a CCD array.

22. A feeder according to claim 17, further comprising a plurality of output locations, the feed system being adapted to feed documents and separators to an appropriate one of the output locations depending on the information obtained by the sensing system.

23. A feeder according to claim 17, further comprising a single output location to which the documents and separators are fed.

24. A document feeder according to claim 17, the feeder forming part of a document counter, sorting assembly or acceptor.

25. A document supply apparatus comprising:

a single storage location for holding a stack of documents;

a feed system for feeding documents only from said single storage location; and a detector for detecting one or more characteristics of a document, the feed system feeding the document in accordance with the detected characteristic, wherein the detected characteristic(s) relate to one or more of authenticity, condition, fitness, and denomination or other predetermined pattern of the document, and wherein the detector includes a sensor located so as to sense the document characteristic(s) while the document is in the storage location.

26. Apparatus according to claim 25, wherein the feed system is adapted to feed documents to one of a number of different destinations chosen in accordance with the detected characteristic(s).

27. Apparatus according to claim 25, wherein the sensor is located so as to view documents through a floor of the storage location.

* * * * *